United States Patent [19]

Nakamura et al.

[11] Patent Number: 4,659,233

[45] Date of Patent: Apr. 21, 1987

[54] TIMEPIECE WITH BUILT-IN TIMER

[75] Inventors: Norihiko Nakamura, Tokyo; Hideki Morishima, Yokohama, both of Japan

[73] Assignee: Rhythm Watch Co., Ltd., Tokyo, Japan

[21] Appl. No.: 599,151

[22] Filed: Apr. 11, 1984

[30] Foreign Application Priority Data

| | | | |
|---|---|---|---|
| Apr. 12, 1983 | [JP] | Japan | 58-65082 |
| Apr. 14, 1983 | [JP] | Japan | 58-66780 |
| Apr. 18, 1983 | [JP] | Japan | 58-68814 |
| May 6, 1983 | [JP] | Japan | 58-79610 |
| Sep. 5, 1983 | [JP] | Japan | 58-163968 |
| Mar. 27, 1984 | [JP] | Japan | 59-43941[U] |

[51] Int. Cl.[4] ..... G04B 23/00

[52] U.S. Cl. ..... 368/260; 368/261; 368/107; 368/108; 368/109; 368/113; 368/243

[58] Field of Search ..... 368/261–263, 368/250, 251, 107–109, 113, 260

[56] References Cited

U.S. PATENT DOCUMENTS

| | | | |
|---|---|---|---|
| 2,253,929 | 8/1941 | Campbell | 368/109 |
| 2,344,853 | 3/1944 | Haes | 368/109 |
| 3,733,802 | 5/1973 | Wisser | 368/248 |
| 3,759,032 | 9/1973 | Bassett et al. | 368/108 |
| 3,807,165 | 4/1974 | Kawada | 368/261 |
| 4,246,651 | 1/1981 | Komatsu et al. | 368/263 |

*Primary Examiner*—Bernard Roskoski

*Attorney, Agent, or Firm*—Koda and Androlia

[57] ABSTRACT

The present invention provides a timpiece including clock and timer sections which can be operated solely or in association with each other. When the clock and timer sections are combined with each other, the start of the timer section is controlled by an alarm signal from the clock section such that two different alarm functions can be attained. The alarm signal is preferably in the form of an alarm output or alarm pause output. The clock and timer secitons may be connected into a unit or mechanically disconnected from each other. When the clock section can be separated from the timer section, the state of connection therebetween and the life of a battery used can warningly be indicated.

3 Claims, 20 Drawing Figures

TIMEPIECE WITH BUILT-IN TIMER

BACKGROUND OF THE INVENTION

1. Field of the Invention

The present invention relates to a timepiece having a built-in timer, and particularly to a timepiece including an alarm clock mechanism and a timer mechanism such that a unique secondary alarm function can be realized in addition to the conventional alarm and timer functions.

2. Prior Art

There are well known a clock mechanism, particularly an alarm clock mechanism and a timer mechanism which are separately provided in the market. The alarm clock mechanism indicates times and alarms a preset time while the timer mechanism controls the creation of the warning sound or an electrical switch after passaged of a preselected time period. More particularly, the alarm clock mechanism includes a source of reference rotation such as a motor or the like, an indicating section driven by the motor through any suitable reduction gearing to indicate times, and an alarm contact unit for generating a signal at its output when the indicating section reaches a reset time. The signal from the alarm contact unit is used to trigger any alarm device or others. On the other hand, the timer mechanism includes a source of reference rotation such as a motor or the like, a time setting disc manually rotated to the desired setting position at which the rotation of said motion is initiated, a timer gear train for reducing the rotational speed of the motor and transmitting it to the timer setting disc so that the latter is rotated in the opposite direction, and a timer contact unit operably associated with the timer setting disc to generate a timer output after passage of a preselected time period, this time output being used to cause any actuation of the timer.

There has recently been proposed a timepiece in which the alarm clock mechanism is operably combined with the timer mechanism. The alarm clock mechanism performs its inherent function while the timer mechanism controls any time period in cocking, preparing the bath and others. It has been found that such a timepiece is very convenient in practice.

Although this composite timepiece is advantageous in that the clock and timer mechanisms can be combined into a unit and selectively be functioned singly, it provides no new function created from the combination of the clock with the timer.

SUMMARY OF THE INVENTION

It is therefore, an object of the present invention to provide a timepiece including a clock and timer mechanism which can add a new function created from the combination of the clock with the timer.

In accordance with the present invention, an alarm clock mechanism is electrically connected with a timer mechanism to transmit signals from one to another such that a secondary alarm function is newly provided in addition to the conventional and individual functions of the clock and timer mechanisms.

This secondary alarm function may be provided by controlling the start of the timer in response to a signal from the alarm clock mechanism, opposed to the conventional timer function which is used to meter the passage of time starting when the timer is set. This control signal may be in the form of an alarm signal, alarm pause signal or any other suitable signal. Therefore, the present invention basically generates two alarm signals distinguished from each other, but operably associated with each other. The first alarm signal is the same one as that of the conventional alarm clock mechanism while the second alarm signal is obtained from the timer mechanism which is adapted to be started on receiving said alarm signal or any other signal relating the alarm signal, such as an alarm pause signal or the like.

If the timepiece according to the present invention is utilized as an alarm clock, the second alarm function is useful in that two users can be warned at different hours of rising, for example.

The timepiece according to the present invention can similarly be utilized to control two different electric instruments at preselected different times.

Another object of the present invention is to provide a timepiece of the above type in which the alarm clock mechanism and the timer mechanism can optionally be disconnected from each other so that they perform their respective functions separately. For such purpose, the clock and timer mechanisms are separately connected to differnent sources of power.

Still another object of the present invention is to provide a timepiece of the above type in which the connection between the clock and timer mechanism can be indicated by any suitable means to avoid the use of the timepiece when there is an improper electric connection therebetween. This can prevent use of the timepiece when there is an unexpected failure of the electric connection or insulation. Such an indication can also be used to check the power voltage, for example, to the timer.

To accomplish the above objects, the present invention provides a timepiece which comprises a clock section including a time indicating portion driven by a motor through a clock gear train and an alarm portion cooperating with the clock gear train to generate an alarm output signal at a preselected time, and a timer section driven by a motor through a timer gear train and including a timer contact unit operably associated with the timer gear train to generate timer output after passage of a preselected time period, the start of the timer section being controlled by a control signal from the alarm portion of the clock section.

The present invention also provides a timepiece which comprises a clock section including a time indicating portion driven by a motor through a clock gear train and an alarm portion cooperating with the clock gear train to generate an alarm output signal at a preselected time, and a timer section driven by a motor through a timer gear train and a timer contact unit operably associated with the timer gear train to generate a timer output after passage of a preselected time period, the clock and timer sections being separatably connected with each other, the start of the timer section being controlled by the alarm output from the clock section.

The present invention further provides a timepiece which comprises a clock section including a time indicating portion driven by a motor through a clock gear train and an alarm portion cooperating with the clock gear train to generate an alarm output at a preselected time, and a timer section driven by a motor through a timer gear train and a timer contact unit operably associated with the timer gear train to generate a timer output after passage of a preselected time period, the clock and timer sections being separatably connected with each other, the start of the timer section being controlled by the alarm output from the clock section, and the clock section further including indicator means for indicating the state of connection between the clock and timer such that the state of connection is warned in response to a connection indicating signal supplied from the timer section.

DETAILED DESCRIPTION OF THE INVENTION

Figure 1:
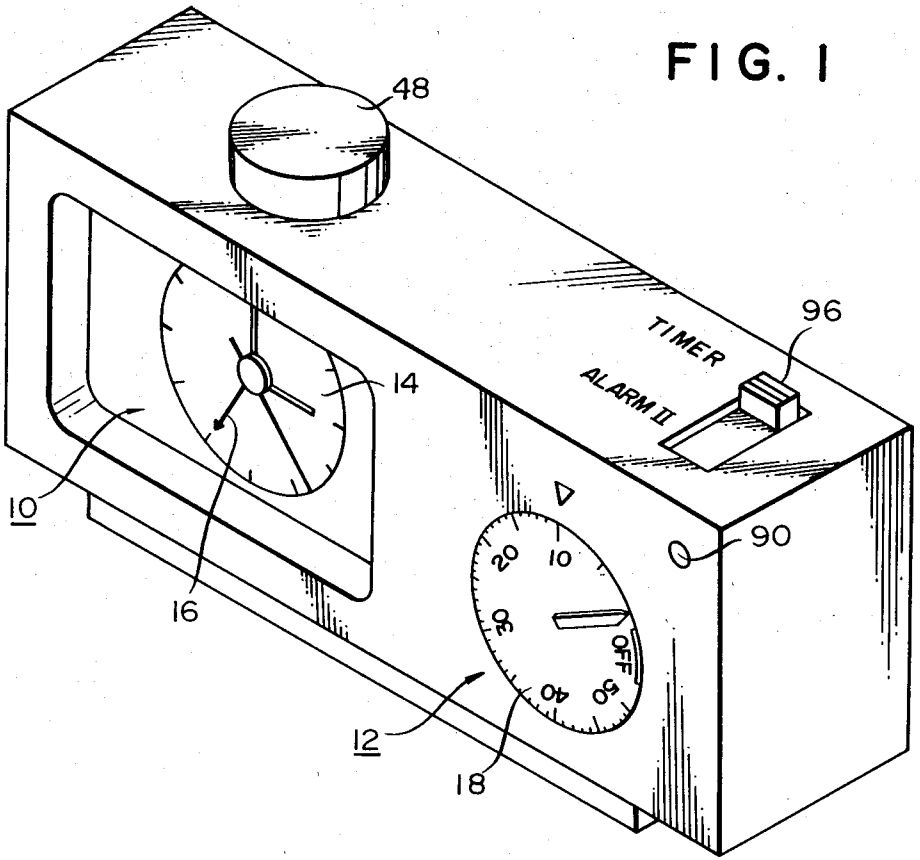
FIG. 1 is a perspective view of a timepiece which is the first embodiment of the present invention.
Figure 2:
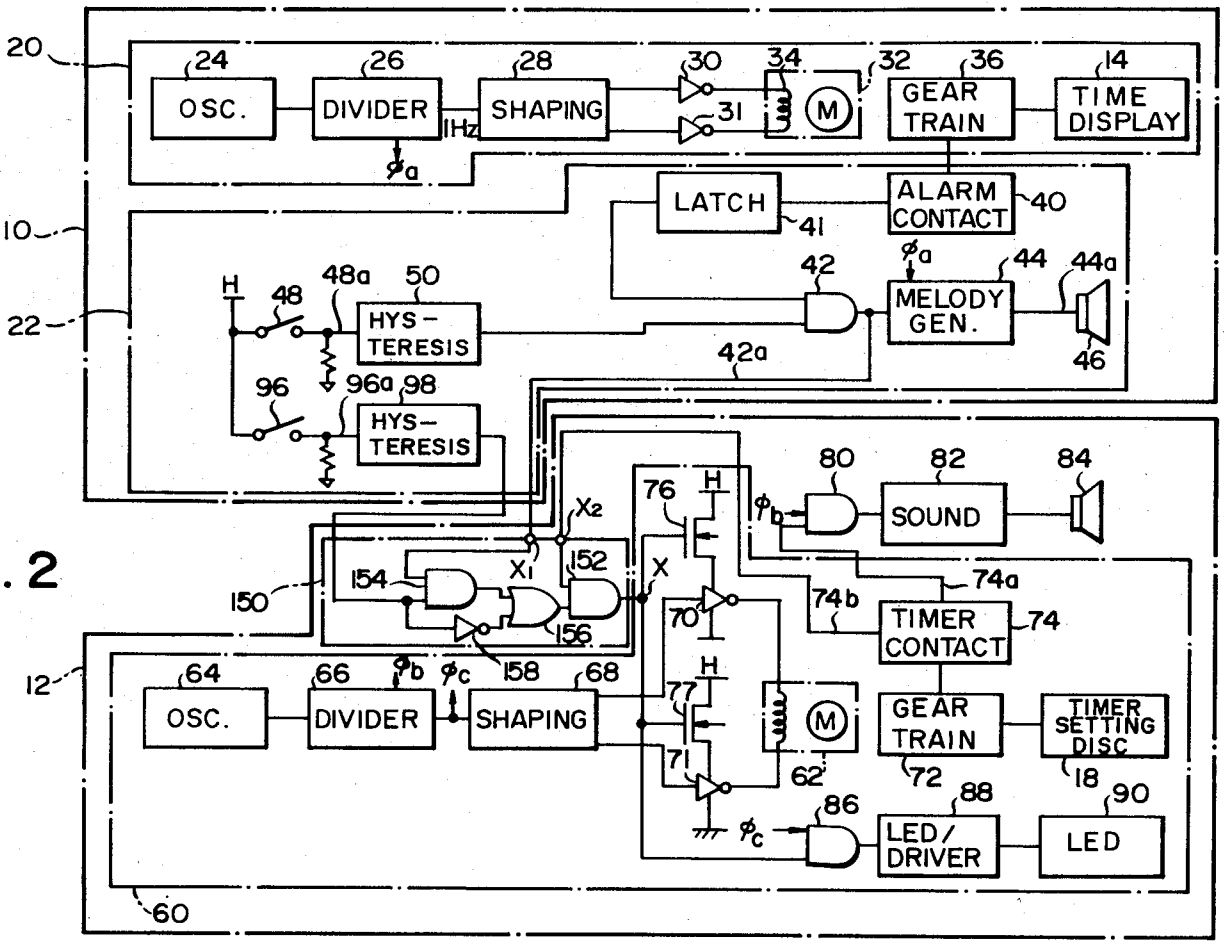
FIG. 2 is a circuit diagram of the timepiece shown in FIG. 1.

FIG. 1 shows a timepiece including a clock section 10 and a timer section 12 which are connected integrally with each other while FIG. 2 shows the clock and timer sections 10 and 12 which are disconnected and used separately from each other.

The clock section 10 includes a time indicating portion 14 having a dial, time indicating hands, and an alarm hand 16.

On the other hand, the timer section 12 includes a timer setting disc 18 which can externally be rotated and is operably associated with a timer gear train within the timepiece.

FIG. 2 shows a circuit diagram of the first embodiment of the timepiece according to the present invention. As seen from FIG. 2, the clock section 10 also includes a time ticking portion 20 and an alarm setting portion 22.

The time ticking portion 20 includes an oscillating circuit 24 generating a reference signal, such as crystal oscillator or the like. The output of the oscillating circuit 24 is divided by a frequency divider 26, for example, into a low frequency signal of about one Hertz which is in turn shaped by a shaping circuit 28. The output of the shaping circuit 28 is supplied to a stator coil 34 of a clock step motor 32 through drive inverters 30 and 31. As well known, drive pulses applied to the stator coil 34 from the inverters 30 and 31 include alternating pulses having alternately different polarities.

The rotation of the step motor 32 is reduced by a clock gear train 36 to provide a drive which causes the time indicating hands in the time display 14 to indicate times in an analogue manner.

The alarm portion 22 includes an alarm contact unit 40 operably associated with the clock gear train 36. The alarm contact unit 40 may be constituted of alarm contact plates on the hour-hand and alarm wheels in the clock gear train 36 and is adapted to generate an alarm output signal when the indicated time coincides with a preselected alarm time. The alarm signal is supplied to a melody generating circuit 44 through a latch 41 and AND gate 42 to generate the desired alarming sound (melody) at a loudspeaker 46. In the illustrated embodiment, the melody generating circuit 44 is adapted to receive a reference signal $\phi a$ (for example, 2048 Hz) from said frequency dividing circuit 26 and to generate a melody sound controlled in accordance with the frequency of this reference signal.

The AND gate 42 has the other input receiving the output of an alarm pause switch 48 through a hysteresis circuit 50. When the alarm pause switch 48 is opened as shown in FIG. 2, the AND gate 42 is then closed to stop the alarm even upon receiving the alarm output signal from the alarm contact unit 40. The alarm pause switch 48 includes, as seen from FIG. 1, a manipulating portion extending outwardly from clock section 10 such that the alarm pause switch 48 can manually be operated. The alarm pause switch 48 is normally positioned open or closed under the action of a double-acting mechanism.

The timer section 12 includes the conventional timer circuit 60 which includes a timer step motor 62 for providing a source of reference rotation. For driving this step motor 62, the timer section 12 also includes an oscillating circuit 64, a frequency dividing circuit 66, a shaping circuit 68 and drive inverters 70 and 71 as in the aforementioned time ticking portion 20.

The rotation of the timer step motor 62 is reduced by a timer gear train 72 to drive the timer setting disc 18 at a predetermined speed, for example, one revolution per about 60 minutes as in the illustrated embodiment. The timer gear train 72 is operably connected with a timer contact unit 74 such that the latter can be actuated to generate a timer signal 74*a* after passage of a preselected time period.

The timer contact unit 74 also generates output signals 74*b* used to detect the set state of the timer setting disc 18, the output signals 74*b* including a "L" signal produced when the timer setting disc 18 is in its off position and a "H" signal produced when the timer setting disc 18 is rotated to and set at a preselected setting time. These signals are used to control the timer pulse motor 62.

More particularly, the timer step motor 62 is controlled by the drive inverters 70 and 71 as aforementioned. The inverters 70 and 71 may be energized respectively by N-MOS transistors 76 and 77 which are in turn controlled by the output of a selector circuit 150. Thus, the timer pulse motor 62 can be driven only when signals are supplied from the selector circuit 150 to the transistors 76 and 77. The selector circuit 150 includes an AND gate 152 the input of which is adapted to receive the setting signal 74*b* from the timer contact unit 74. The AND gate 152 is permitted to generate an output signal only when the timer setting disc 18 is in its set state. It is thus understood that the timer pulse motor 62 can be energized only when the timer setting disc 18 is in its set state. It is of course that the timer pulse motor 62 can be energized only by the other trigger signal, for example, an alarm input signal from the clock section 10 when the clock and timer sections 10 and 12 are electrically connected with each other.

The timer signal 74*a* of the timer contact unit 74 is supplied to an AND gate 80 together with a timer sound generating signal $\phi$b (for example, 2084 Hz) which is obtained from the frequency dividing circuit 66. When the input of the AND gate 80 fulfills the desired conditions, the AND gate 80 instructs a loudspeaker 84 to generate a timer sound through a sound generating circuit 82.

The timer contact unit 74 may be in the form of a well-known timer contact mechanism which comprises a movable contact located on the back of the timer setting disc 18 and a stationary contact slidably engaged by the movable contact. As above mentioned, this timer contact mechanism is adapted to generate the "H" set signal 74*b* when the timer setting disc 18 is set, to change the set signal 74*b* to "L" when the timer setting disc 18 is rotated to its OFF position and to generate a "H" timer signal 74*a* at the rotational position of the timer setting disc 18 after passage of a preselected time period.

The output X of the selector circuit 150 is supplied to the gate inputs of the transistors 76 and 77 and also applied to an AND gate 86 together with a flashing signal $\phi$c (0.5 Hz) from the frequency dividing circuit 66. The output of the AND gate 86 is supplied to an LED indicator 90 through an LED/driver circuit 88. As the timer pulse motor 62 is energized, the LED indicator 90 flashes to indicate the operating timer.

The selector circuit 150 is adapted to operate the timer section 12 in either of a mode in which the timer section 12 is operated independently of the clock section 10 or another mode in which the timer section 12 is operated in association with the clock section 10. For this purpose, the AND gate 90 receives at one of its inputs a setting signal 74*b* from the above timer contact unit 74 with the other input being supplied with the signal from the clock section 10 through an AND gate 154 and an OR gate 156. In the illustrated embodiment, the signal of the clock section 10 is taken in the selector circuit 150 through an AND gate 42. In other words, the AND gate 42 receives an alarm signal, the output of the AND gate 42 at one of the inputs thereof with the other input of the AND gate 154 being supplied with a changing signal from a secondary alarm/timer changing switch 96 through a hysteresis circuit 98. The changing signal also is supplied to the OR gate 156 through an inverter 158. As shown in FIG. 1, the secondary alarm/timer changing switch 96 is located on the top of the clock section 10. When the switch 96 is positioned at the secondary alarm mode as shown in FIG. 1, it is turned on to receive a signal exclusively depending on the alarm output of the clock section 10 through the AND gate 154. If the changing switch 96 is moved to the timer mode, it is turned off so that the "H" signal is always outputted from the OR GATE 156 to invalidate the alarm output.

The other output of the AND gate 152 receives the setting signal 74*b* from the timer contact unit 74. It is thus understood that all the signals from the clock section 10 are effective only when the timer section is in its set position.

The first embodiment of the present invention operates in the following manner.

Figure 3:
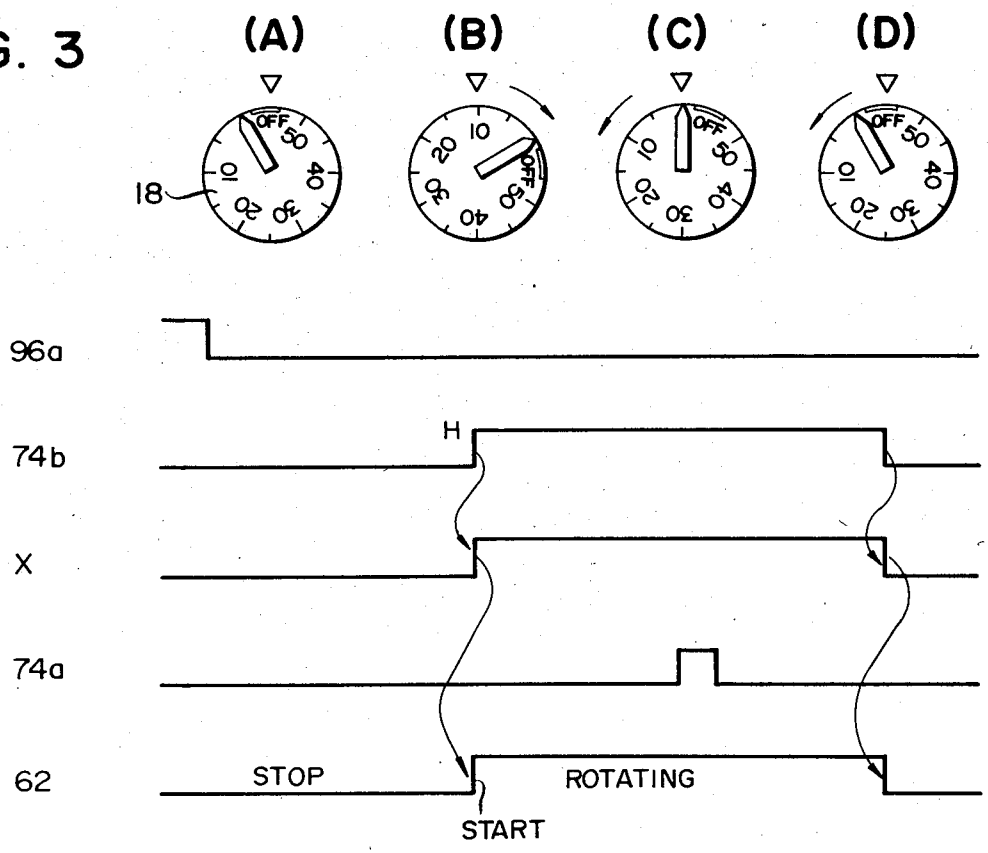
FIG. 3 is a time chart illustrating the separate operations of clock and timer sections in the timepiece shown in FIG. 1.

FIG. 3 illustrates the separate operation of the timer section 12 when it is disconnected with the clock section 10. In FIG. 3A, the timer is not in its set position with the setting signal 74*b* being in "L". The timer step motor 62 is not energized. Simultaneously, the changing switch 96 has its output 96*a* of "L". As a result, the selector circuit 150 depends on the setting signal 74*b* (input $X_2$).

In FIG. 3B, the timer setting disc 18 is set to perform its timer function for ten minutes with the timer output 74*b* being "H". Therefore, the output X of the selector circuit 150 also becomes "H". The timer step motor 62 begins to rotate.

In FIG. 3C, the set period of ten minutes expires with the timer signal 74*a* being produced to cause the desired function of the timer. The pulse width of this timer signal 74*a* is determined depending on the mechanical size of the timer contact unit 74. Thus, the automatic stoppage can be obtained without any particular operation.

As seen from FIG. 3D, the rotation of the timer step motor 62 continues until the timer setting disc 18 is rotated to its OFF position at which the motor 62 is stopped.

Figure 4:
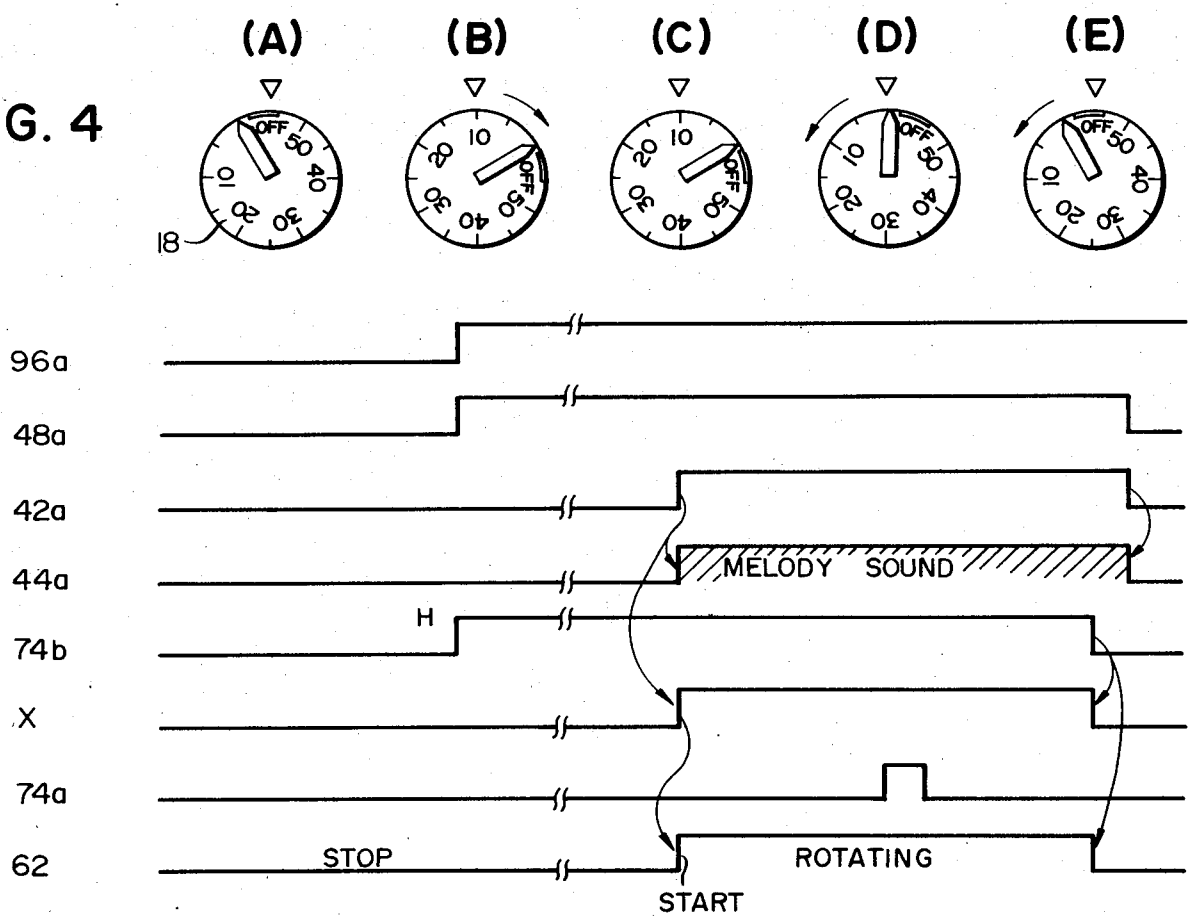
FIG. 4 is a time chart illustrating a second alarm function in the timer section when the clock section is operably connected with the timer section in the first embodiment.

The secondary alarm function obtained by electrically connecting the clock section 10 with the timer section 12 to control the timer function with the alarm output of the clock section 10 will be described with reference to the time chart shown in FIG. 4.

Under the above connection, the output 96*a* of the changing switch 96 becomes "H" and the selector circuit 150 is actuated in response to the output of the alarm position 22.

In the non-set state shown in FIG. 4A, however, the signal X from the selector circuit 150 also is held at "L" level since the setting signal 74*b* is in "L".

In FIG. 4B, when the timer setting disc 18 is set at a preselected position, for example, at ten-minute position, the setting signal 74*b* becomes "H". If the alarm pause switch 48 is simultaneously opened, the timepiece is placed at its stand-by position for the secondary alarm.

FIG. 4C shows the clock section 10 reaching the alarm time in which the AND gate 42 generates an alarm signal 42*a* at the output thereof in response to the signal from the alarm portion 40. As a result, the clock section 10 begins to perform its melody alarm function in response to the output 44*a* of the melody generating circuit 44. At the same time, the output 42*a* of the AND gate 42 is supplied to the input $X_1$ of the selector circuit 150 which in turn generates the output X, that is, an "H" signal. Thus, the timer step motor 62 is energized to rotate.

After the secondary alarm period for ten minutes has expired as shown in FIG. 4D, the timer signal 74*a* is generated to cause the second alarm function.

FIG. 4E shows the timer setting disc 18 returned to its OFF position to stop the rotation of the motor 62.

In such a manner, the first embodiment of the present invention provides the timepiece comprising the clock and timer mechanisms 10 and 12 which can separately or cooperatively be operated.

Figure 5:
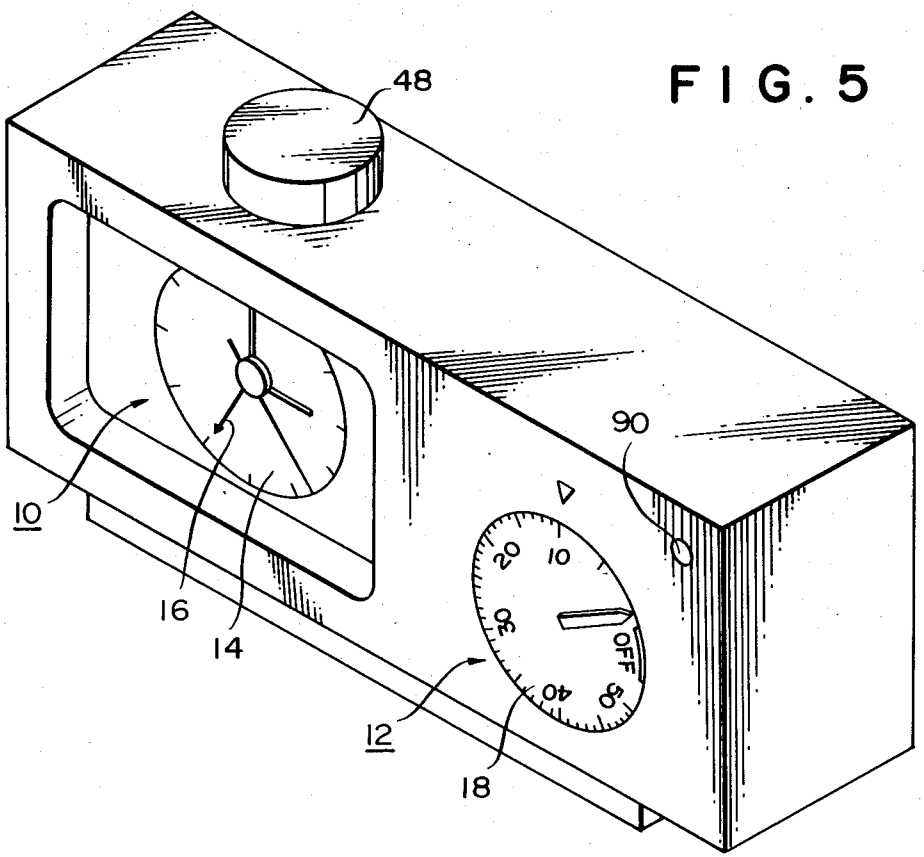
FIG. 5 is a perspective view of a timepiece which is the second embodiment of the present invention.

The second embodiment of the present invention is shown in FIG. 5 in which similar parts are denoted by similar reference numerals.

The second embodiment is characterized in that the secondary alarm/timer changing switch 96 as in the first embodiment is omitted while the timer section 12 is always controlled by the alarm output of the alarm portion 22 with respect to the secondary alarm function.

Figure 6:
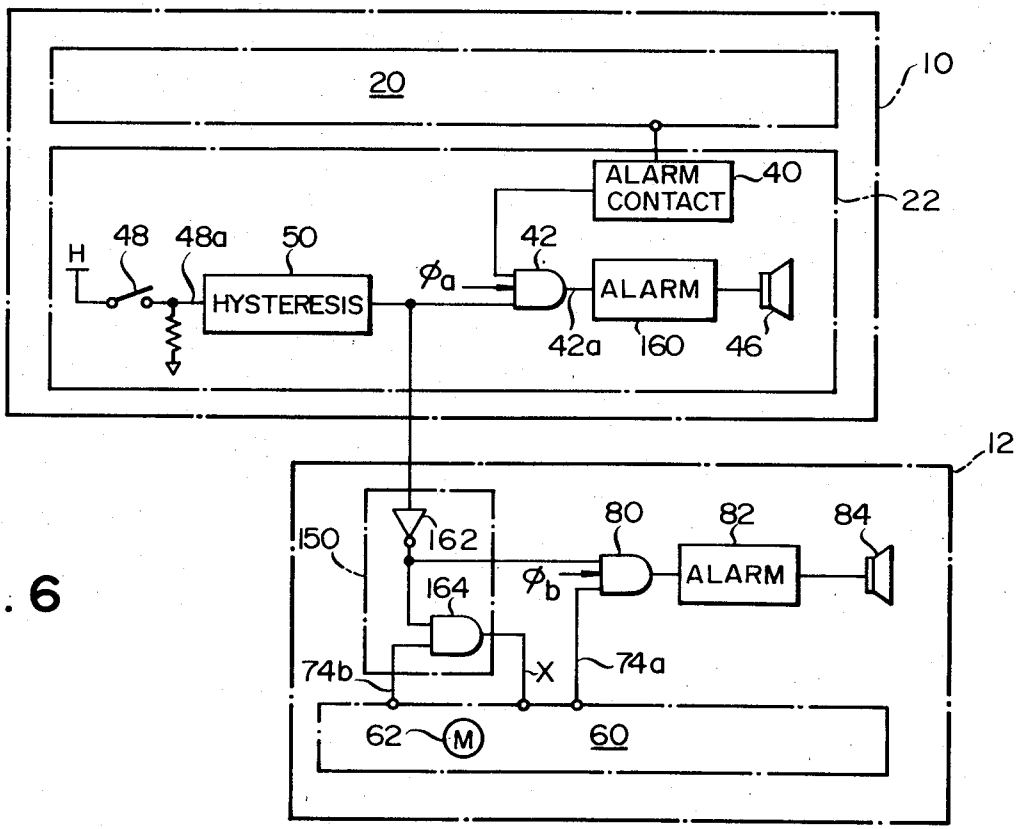
FIG. 6 is a circuit diagram of the main part of the second embodiment.

FIG. 6 is a circuit diagram of the second embodiment in which similar parts are designated by similar reference numerals and unnecessary parts are omitted.

As seen from FIG. 6, the alarm portion 22 comprises an alarm circuit 160 in place of the melody generating circuit 44 as in the first embodiment. The alarm circuit 160 is responsive to the alarm output of the alarm contact unit 40 to generate an alarm sound continuously as the alarm contact unit 40 is in its ON state, since the latch circuit 41 as in the first embodiment is omitted. It is of course that the alarm circuit 160 can be de-energized by opening the alarm pause switch 48.

The second embodiment of the present invention has a further feature that the output of the alarm portion 22 includes an alarm pause signal from the alarm pause switch 48 in addition to the first feature that the timer section 12 is controlled by the alarm output of the alarm portion 22 at all times. More particularly, the alarm pause signal is supplied from the hysteresis circuit 50 to an inverter 162 in the selector circuit 150 of the timer section 12. The output of the inverter 162 is then supplied to an AND gate 164 together with the setting signal 74*b* of the timer contact unit 74. Thus, the timer step motor 62 can be started only by closing the alarm pause switch 48.

The output of the inverter 162 also is supplied to the other input of the AND gate 80 such that the alarm sound can be generated only when the alarm circuit 160 is in its OFF state.

In accordance with the second embodiment, the timer 12 can be disconnected and operated separately from the clock section 10 when the alarm pause switch 48 is closed independently of the output of the alarm contact unit 40. More particularly, the closing of the alarm pause switch 48 causes the AND gate 162 of the selector circuit 150 to position in its open state at all times. As a result, the timer section 12 can be actuated only by the setting signal 74*b* produced when the timer setting disc 18 is rotated.

Figure 7:
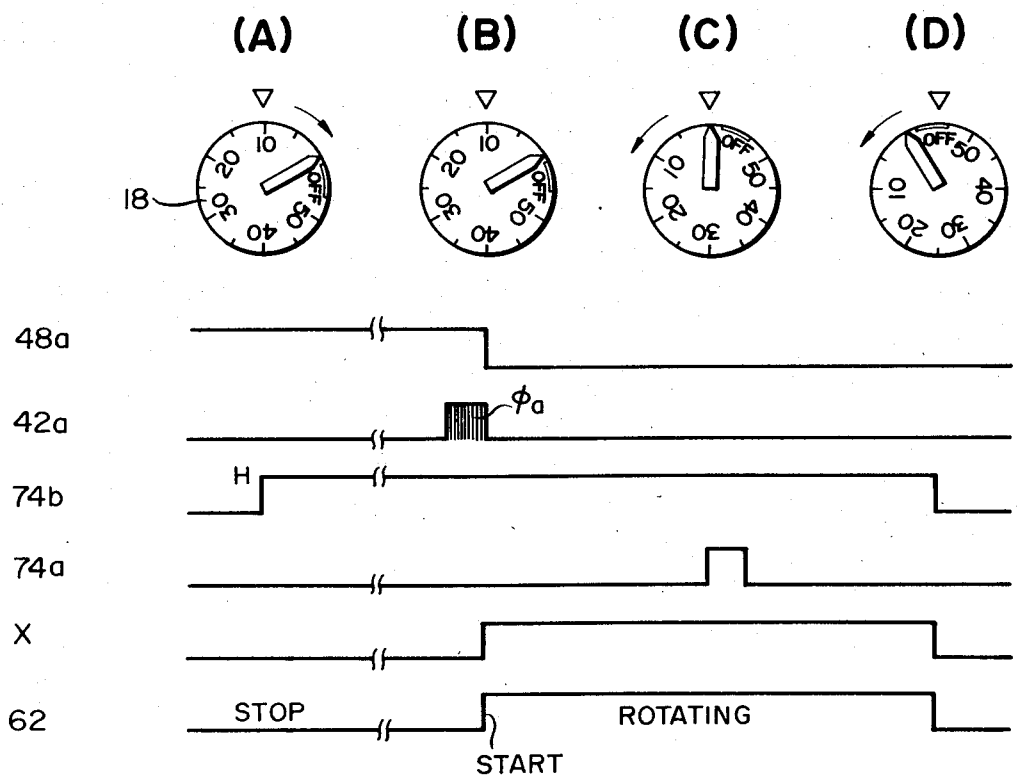
FIG. 7 is a time chart illustrating a secondary alarm function in the second embodiment.

The operation of the second embodiment will be described with reference to FIG. 7.

Reference is first made to cause where the timepiece according to the present invention is utilized simply as an alarm clock. The alarm pause switch 48 is in its closed position. The alarm sound will be generated at an alarm set time. The alarm sound can be stopped simply by opening the alarm pause switch 48.

In the timer mode, the alarm pause switch 48 is continuously in its open state while the timer setting disc 18 is rotated to the desired timer setting time. Simultaneously, the timer step motor 62 begins to rotate. After passage of the desired time period, the timer sound is intermittently generated. When it is wanted to stop the timer sound, the timer setting disc 18 may simply be rotated to its OFF position.

The secondary alarm function, which is one of the features of the invention, will be described below.

This secondary alarm function can be obtained by functionally combining the clock section 10 with the timer section 12. More particularly, the clock section 10 is set to have the desired alarm time while the timer section 12 is set to have the timer setting disc 18 which has been rotated to the desired time. The alarm pause switch 48 is placed in its closed position.

Thus, the clock and timer sections 10 and 12 are simultaneously set to have the desired alarm and timer times, respectively. Since the alarm pause switch 48 is in its closed position, however, the timer step motor 62 is inoperative. Reference is now made to the time chart shown in FIG. 7.

In FIG. 7A, the timer setting disc 18 is set at ten-minute position. The setting signal 74*b* of the timer contact unit 74 becomes "H" at the same time when the timer setting disc 18 begins to be rotated. However, the output X of the AND gate 164 becomes "L" since the output 48*a* of the alarm pause switch 48 is in "H" (closed position). Therefore, the timer step motor 62 is inoperative.

In FIG. 7B, the set alarm time period expires in the clock section 10. The AND gate 42 generates at its output a reference signal $\phi a$ used to produce the alarm sound. When the alarm sound is stopped by opening the alarm pause switch 48, the output 48*a* thereof becomes "L". As a result, the output X of the AND gate 164 becomes "H". The timer step motor 62 initiates to rotate.

In FIG. 7C, the rotation of the timer step motor 62 causes the timer setting disc 18 to rotate to its home or OFF position. When the set time period expires, the timer output 74*a* of the timer contact unit 74 becomes "H". This shows the creation of the timer sound. The width of the timer output 74*a* is determined in accordance with the corresponding contact width in the timer contact unit 74. Therefore, the timer can automatically be stopped without any particular operation.

The timer step motor 62 continues to rotate after the timer output 74*a* has been generated. When the timer setting disc 18 is rotated to a position shown in FIG. 7D, the setting signal 74*b* becomes "L" to stop the timer step motor 62.

The above operation is characterized by the fact that the timer sound can be utilized as the secondary alarm sound. In fact, an alarm time is first set in the clock section 10 such that the alarm sound will be obtained at that alarm time. Thereafter, a secondary alarm period equal to a difference between the primary and secondary alarm times is set by rotating the timer setting disc 18 in the timer section 12. For example, when it is desired to generate the primary alarm sound at 7 a.m. in the clock section 10 and then to produce the secondary alarm sound at 7:10 a.m., the timer setting disc 18 is manually rotated to its ten-minute position. At 7:00 a.m., the primary alarm sound is generated. After passage of ten minutes starting when the alarm pause switch 48 is opened to stop the primary alarm sound, that is, at 7:10 a.m., the secondary alarm sound is generated.

The above function is very effective when the same timepiece is utilized by two users or when time is managed in various manners.

In addition to the secondary alarm sound produced after passage of the desired time period from the creation of the primary alarm sound, the timepiece according to the present invention may be used to energize or de-energize any other electric instrument such as radio, TV or the like after passage of any set time period.

Figure 8:
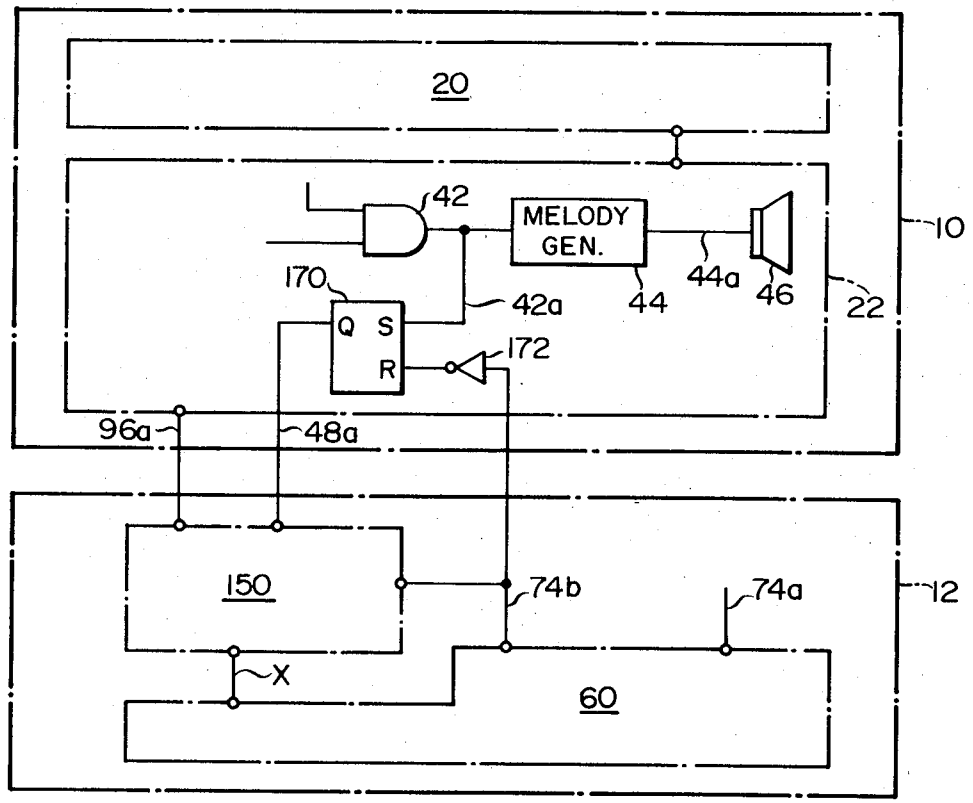
FIG. 8 is a circuit diagram of the main part of the third embodiment according to the present invention.

The third embodiment of the invention is shown in FIG. 8 in which similar parts are denoted by similar reference numerals and unnecessary parts are omitted.

The third embodiment is characterized in that the alarm output 42*a* of the first embodiment is used as an secondary alarm starting signal and is supplied to the timer section 12 from the alarm portion 22 through a flip-flop 170. The flip-flop 170 is triggered by the alarm signal 42*a* such that the flip-flop 170 continues to generate a signal Q even if the alarm output 42*a* is removed. Therefore, the step motor 62 of the timer section 12 can continue to rotate independently of the removal of the alarm output 42*a*.

In the third embodiment, the setting signal 74*b* of the timer contact unit 74 is supplied to the reset input of the flip-flop 170 through an inverter 172. Thus, the flip-flop 170 can be reset after completion of the secondary alarm function.

The combination of the timer function with the alarm function in the third embodiment will now be described with reference to the time chart shown in FIG. 9 in which a changing switch 96 is depicted to be in its closed position.

In FIG. 9A, the timer section 12 is not set and the setting signal 74*b* of the timer contact unit 74 is in "L". The timer step motor 62 is thus inoperative.

In FIG. 9B, the alarm pause switch 48 is closed and the timer setting disc 18 is in the ten-minute position. The timer output 74*a* becomes "H" and the AND gate 42 has its output "L". Thus, the output Q of the flip-flop 170 becomes "L" so that the output X of the selector circuit 150 is held at "L". The timer step motor 62 is then inoperative.

In FIG. 9C, the set alarm period expires to place the alarm output 42*a* in "H". The melody generating circuit 44 is then actuated to generate an alarm melody through the loudspeaker 46. The alarm output 42*a* at "H" level functions to place the output Q of the flip-flop 170 at "H" level such that the output X of the selector circuit 150 is placed at "H" level. Thus, the timer step motor 62 begins to rotate.

Thereafter, the alarm pause switch 48 is opened to stop the melody sound. However, the output Q of the flip-flop 170 is held at "H" and then the timer step motor 62 continues to rotate.

In FIG. 9D, starting when the timer step motor 62 initiates its rotation, the set timer period (ten minutes) expires to make the timer output 74*a* at "H" level. Thus, the timer sound is generated as the secondary alarm sound.

In FIG. 9E, the rotation of the timer setting disc 18 causes the setting signal 74*b* to become "L" so that the timer step motor 62 is stopped. The setting signal 74*b* resets the flip-flop 170 through the inverter 172.

Figure 9:
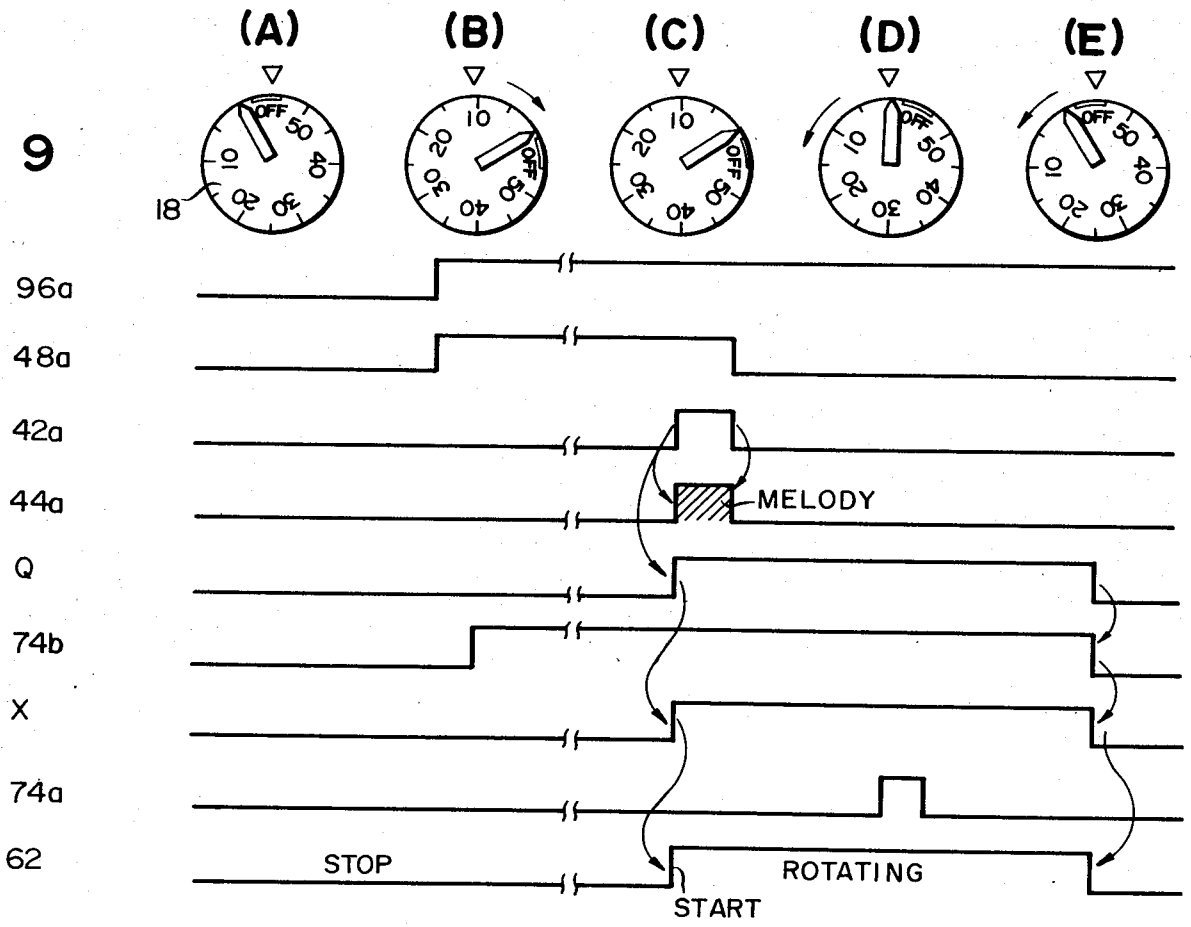
FIG. 9 is a time chart illustrating a secondary alarm function in the third embodiment.

The time chart of FIG. 9 illustrates the stoppage of the melody sound after passage of a reduced time period. However, even if the alarm pause switch is not opened to continue the melody sound immediately after the state shown in FIG. 9C, the timer sound can be generated under the state shown in FIG. 9E. Thereafter, the melody sound can be stopped.

FIG. 9 shows the special function of the invention in the timer section 12. When the changing switch 96 is closed, the timer section 12 is operably associated with the clock section 10 and controlled by the alarm output of the clock section 10. More particularly, the timer section 12 remains inoperative even if the timer setting disc 18 is rotated prior to expiration of the set alarm period in the clock section 10. The timer can be actuated only when the set alarm period expires. Accordingly, the timer sound can be utilized as the secondary alarm sound.

Such a function is extremely advantageous, for example, when the same timepiece according to the invention is used by two users or when it is wanted that a user is stepwise woken up. More particularly, when it is required that two different alarm sounds are respectively generated at 7:00 a.m. and 7:10 a.m., the clock section 10 is set at the alarm time, 7:00 a.m. and the timer setting disc 18 is rotated and set at the ten-minute position. The changing switch 96 is closed. Consequently, the alarm melody will be generated at 7:00 a.m. and the timer sound will then be produced at 7:10 a.m. even if the alarm melody has been stopped. Alternately, when it is desired that the user is stepwise woken up, the clock section 10 is set at a time slightly before a time at which the user must actually get out from his bed. The timer section 12 is set at the actual time at which the user should get out from his bed. Thus, the alarm melody continues to sound from the first alarm time so that the user is gradually woken up and will have to get out from his bed at the actual time.

If the timer section is adapted to be set at maximum fifty-minute position, the alarm output of the alarm contact unit 40 may be held at "H" level for sixty minutes longer than the maximum settable period in the timer under the action of the latch circuit 41.

Figure 10:
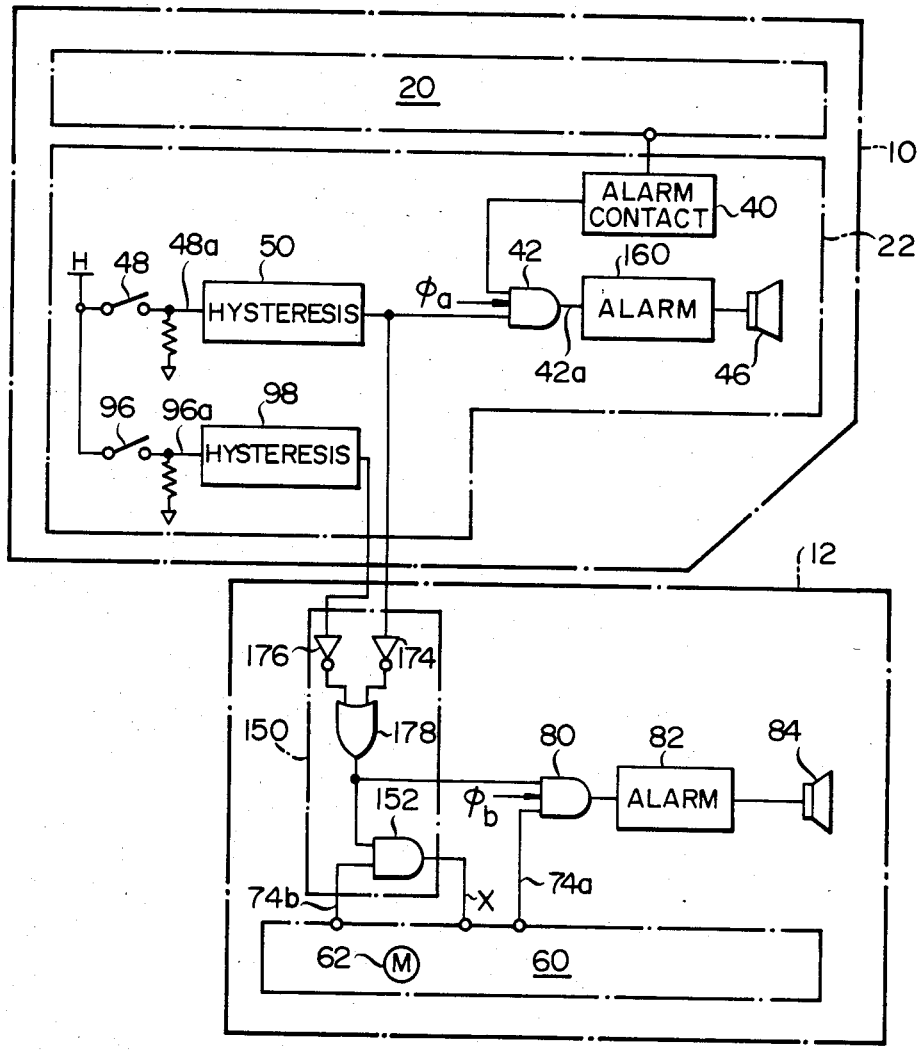
FIG. 10 is a circuit diagram of the main part of the fourth embodiment according to the present invention.

FIG. 10 shows the fourth embodiment of the invention in which similar parts are designated by similar reference numerals and unnecessary parts are omitted.

In the fourth embodiment, the input of the selector circuit 150 is adapted to receive the output 48*a* of the alarm pause switch 48 and the output 96*a* of the secondary alarm/timer changing switch 96. These signals are supplied to the inputs of the AND gates 152 and 80 through the respective inverters 174 and 176 and the OR gate 178.

As in the second embodiment of the invention, the fourth embodiment is such that the secondary alarm function can be started by the alarm pause signal from the alarm portion 22.

Further, the fourth embodiment is such that the timer section 12 can selectively be controlled separately or by the above alarm pause signal from the clock section 10 simply by changing the switch 96 from one position to another.

Figure 11:
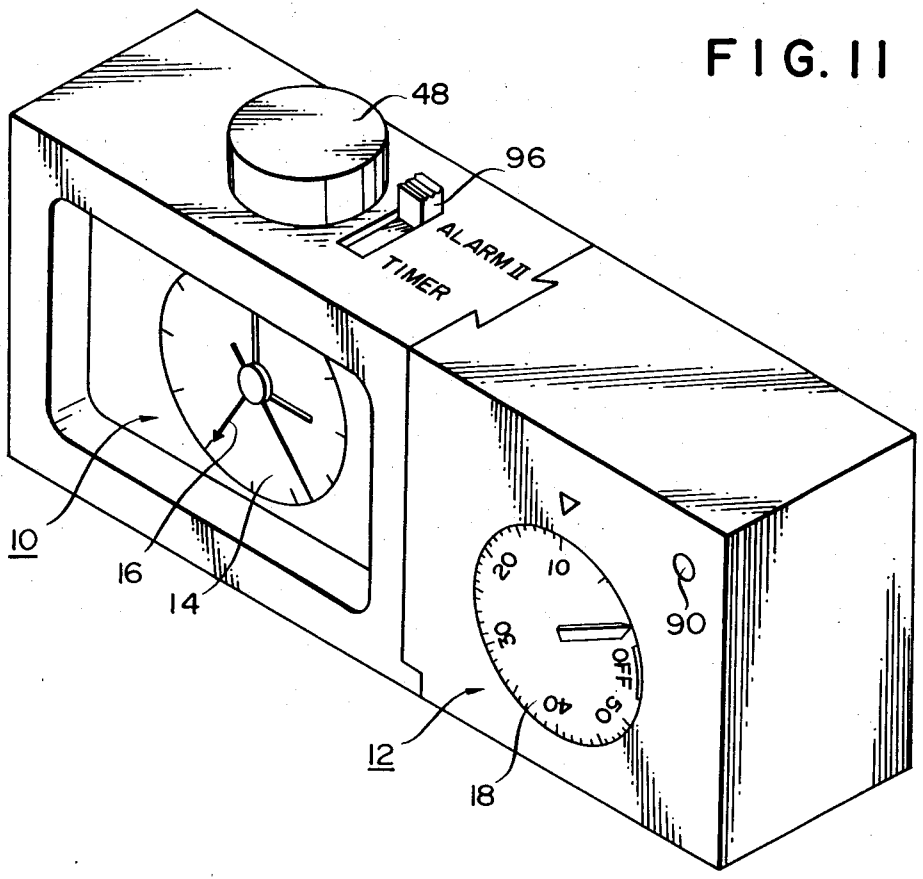
FIG. 11 is a perspective view of the fifth embodiment of the present invention, showing clock and timer sections which can mechanically be disconnected with each other.
Figure 12:
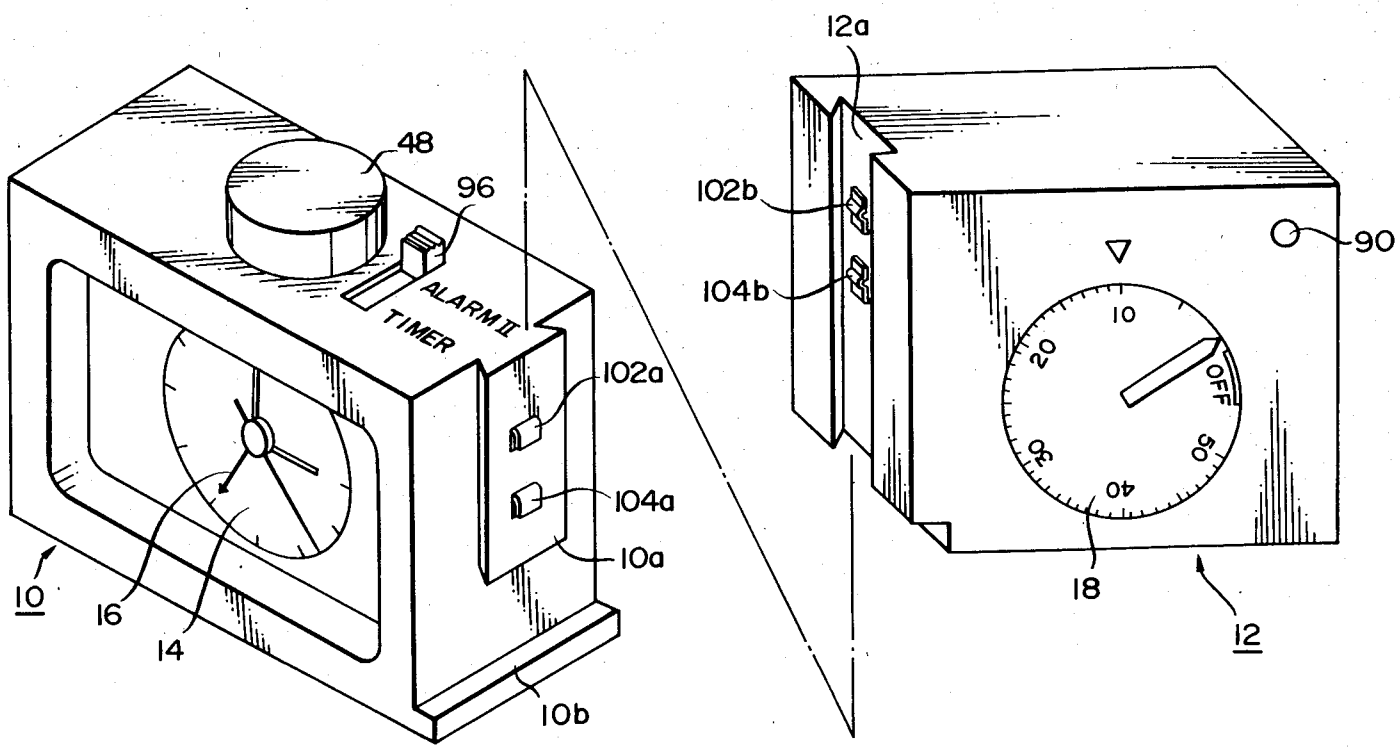
FIG. 12 is a perspective view showing the clock and timer sections when disconnected with each other in the fifth embodiment of FIG. 11.

FIGS. 11 and 12 show the schema of a timepiece which is the fifth embodiment of the invention and in which similar parts are denoted by similar reference numerals and unnecessary parts are omitted.

FIG. 11 shows such a state that the clock section 10 is connected integrally with the timer section 12 while FIG. 12 illustrates such a state that the clock section 10 is disconnected with the timer section 12.

In FIGS. 11 and 12, the clock section 10 includes the time displaying portion 14 having the dial and time indicating hands, and the alarm portion having the alarm hand 16.

On the other hand, the timer section 12 includes the timer setting disc 18 which can manually be rotated and which is operably associated with a timer gear train within the timer section 12.

In the fifth embodiment, the clock and timer sections 10 and 12 are dovetailed to each other. As seen from FIG. 12, the clock section 10 includes a side ridge 10*a* and a bottom overhang 10*b* while the timer section 12 includes a dovetail groove 12. When the dovetail groove 12*a* of the timer section 12 receives the side ridge 10*a* of the clock section 10, the timer section 12 is firmly connected with the clock section 10 as shown in FIG. 11.

Figure 15:
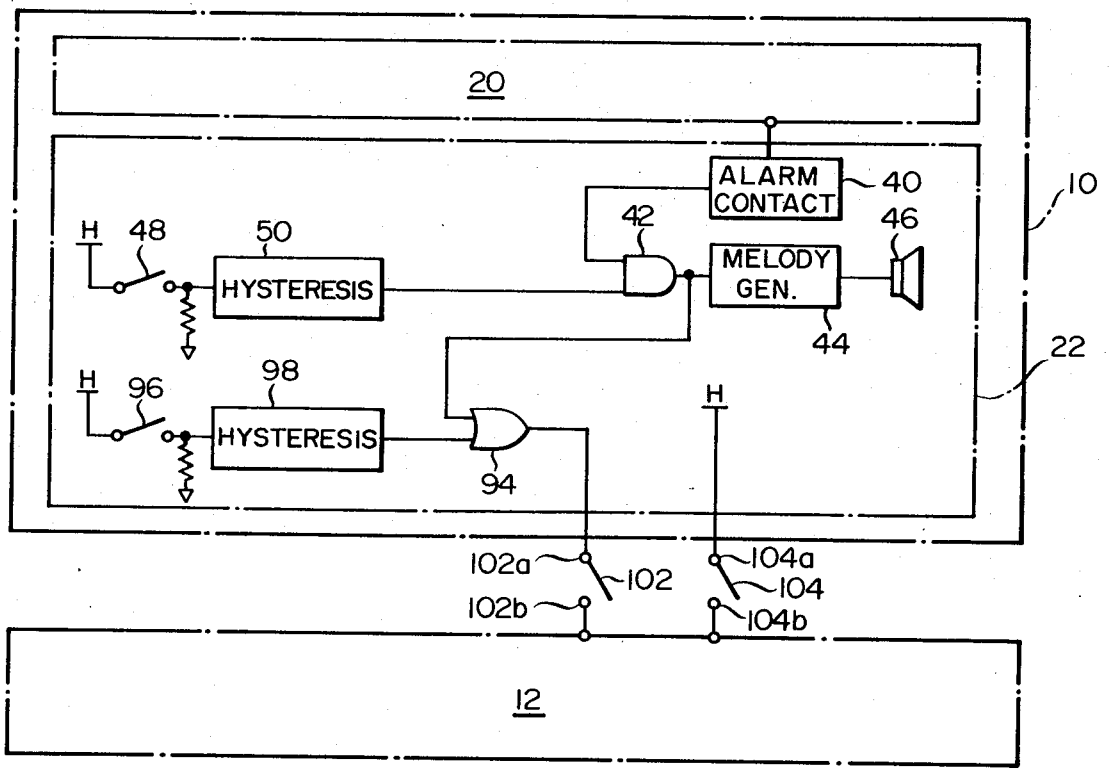
FIG. 15 is a circuit diagram of the main part of the seventh embodiment according to the present invention.

FIG. 15 shows the circuit of the fifth embodiment. The clock section 10 is energized by the power supply $B_1$ while the timer section 12 is energized by another power supply $B_2$.

In the fifth embodiment, the selector circuit 150 includes a multiplexer 78 which is adapted to operate the timer section 12 separately or in association with the clock section 10. For this purpose, one of the inputs $X_2$ of the multiplexer 78 receives the setting signal 74*b* of the timer contact unit 74 with the other input $X_1$ thereof receiving the signal of the clock section 10 through an AND gate 92. This signal of the clock section 10 is the alarm signal of the alarm portion 22 which is taken through an OR gate 94.

The OR gate 94 receives at one input the alarm pause signal 48*a* through an inverter 180 with the other input thereof receiving the changing signal 96*a* from the secondary alarm/timer changing switch 96.

If the changing switch 96 is positioned at the secondary alarm mode, therefore, it is opened and supplied with a signal exclusively depending on the alarm output of the alarm portion 22 through the OR gate 94. If the changing switch 96 is changed to the timer mode, it is closed such that the OR gate 94 generates an output signal which is held at "H" level at all times. Thus, the alarm pause signal will be invalidated.

To change the multiplexer 78 to its input $X_1$ or $X_2$, a changing signal is supplied to the changing input terminal A of the multiplexer 78 from an OR gate 100. The OR gate 100 receives a signal of "H" level from the clock section 10. Thus, the input $X_1$ of the multiplexer 78 becomes effective when the clock section 10 is connected with the timer section 12. When the clock and timer sections 10 and 12 are disconnected from each other, the output X of the multiplexer 78 depends on its input $X_2$.

As seen from FIGS. 11 and 12, the fifth embodiment is such that the clock and timer sections 10 and 12 can be disconnected or connected as required. The electrical connection between the clock and timer sections 10 and 12 can be provided by two sets of contacts 102 and 104 including contact pieces 102*a* and 104*a* in the clock section 10 and contact pieces 102*b* and 104*b* in the timer section 12. When these contact pieces are respectively engaged with one another in the mechanical connection of the clock and timer sections 10 and 12, the AND gate 92 and OR gate 100 in the timer section 12 are electrically connected with the alarm portion 22 of the clock section 10.

As is apparent from the foregoing, the fifth embodiment is such that the dovetail connection between the clock and timer sections 10 and 12 can easily be released. Therefore, the clock and/or timer sections 10 and 12 can separately be used if required.

Figure 14:
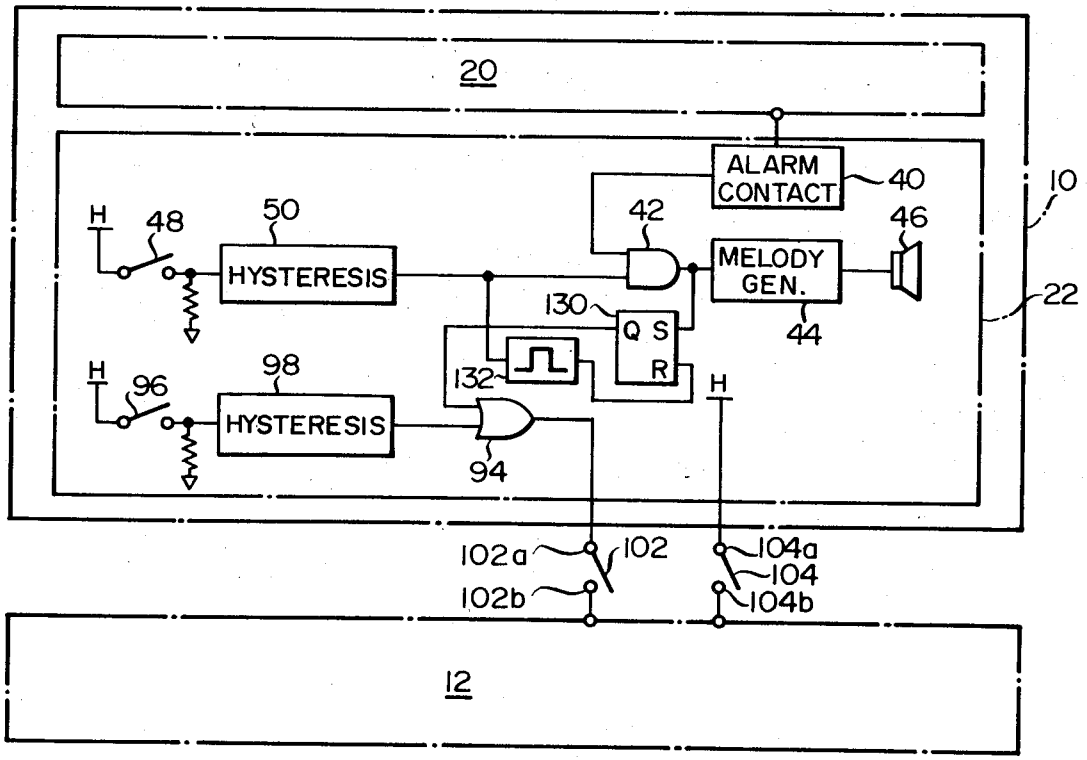
FIG. 14 is a circuit diagram of the main part of the sixth embodiment according to the present invention.

FIG. 14 shows the sixth embodiment of the invention in which parts distinguished from those of the fifth embodiment are only depicted. In the sixth embodiment, the alarm signal 42*a* from the AND gate 42 is used to set a flip-flop 130. If the alarm signal 42*a* is once outputted, the secondary alarm signal is continuously supplied from the flip-flop 130 to the OR gate 94.

The flip-slop 130 is reset by the alarm pause signal 48 through a one-shot circuit 132.

FIG. 15 shows the seventh embodiment of the invention in which similar parts are designated by similar reference numerals and unnecessary parts are omitted.

The seventh embodiment is characterized by that the output of the alarm contact unit 40 is taken in through the OR gate 94 to start the secondary alarm function in the timer section 12. Thus, the secondary alarm function can be controlled directly by the alarm output.

In either of the sixth or seventh embodiment, the timer section 12 can mechanically be disconnected from the clock section 10.

Figure 13:
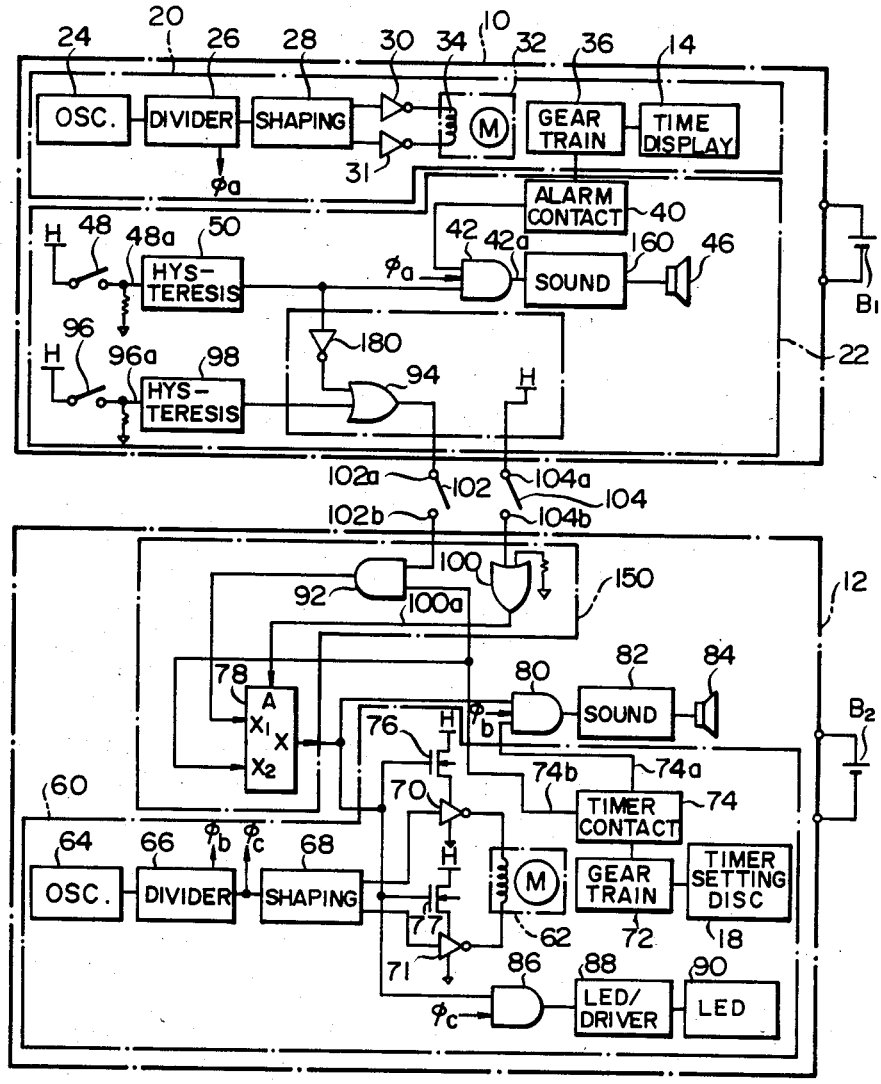
FIG. 13 is a circuit diagram of the fifth embodiment.
Figure 16:
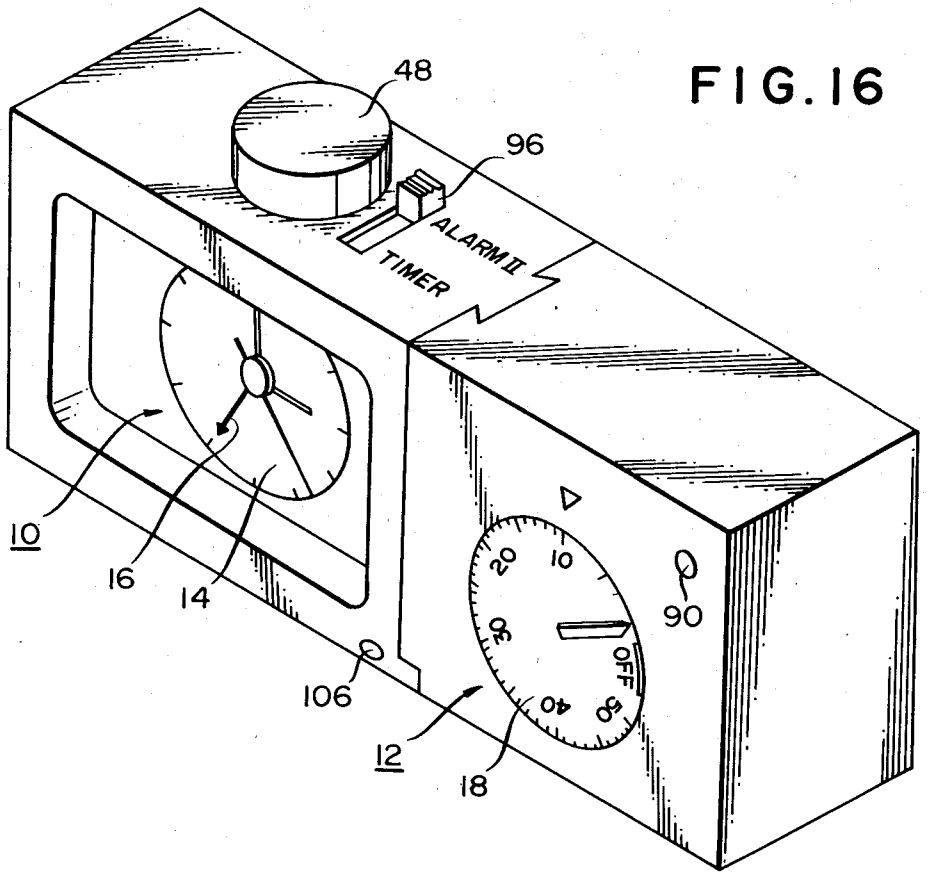
FIG. 16 is a perspective view of the eighth embodiment of the present invention, showing clock and timer sections which can mechanically be disconnected with each other and also warning means for indicating the connection therebetween.
Figure 17:
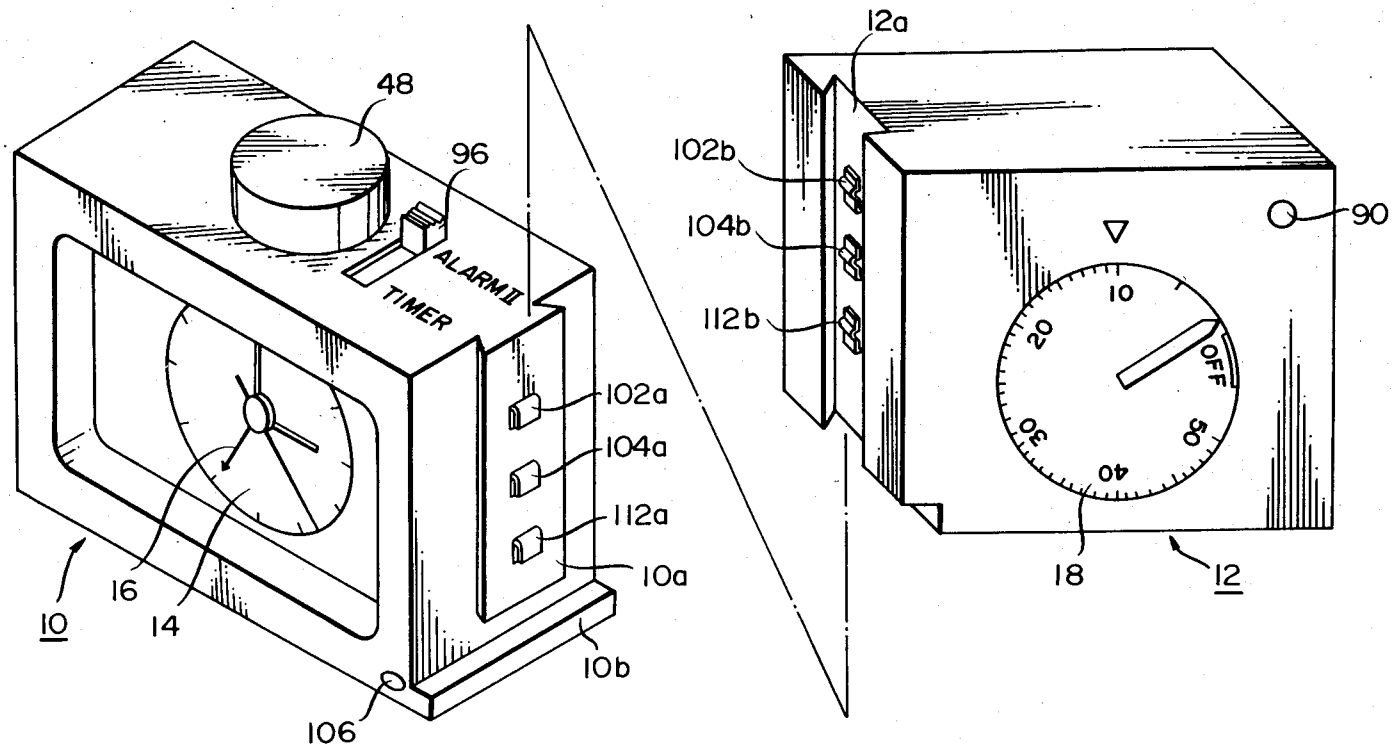
FIG. 17 is a perspective view showing the separation of the clock and timer sections shown in FIG. 16.
Figure 18:
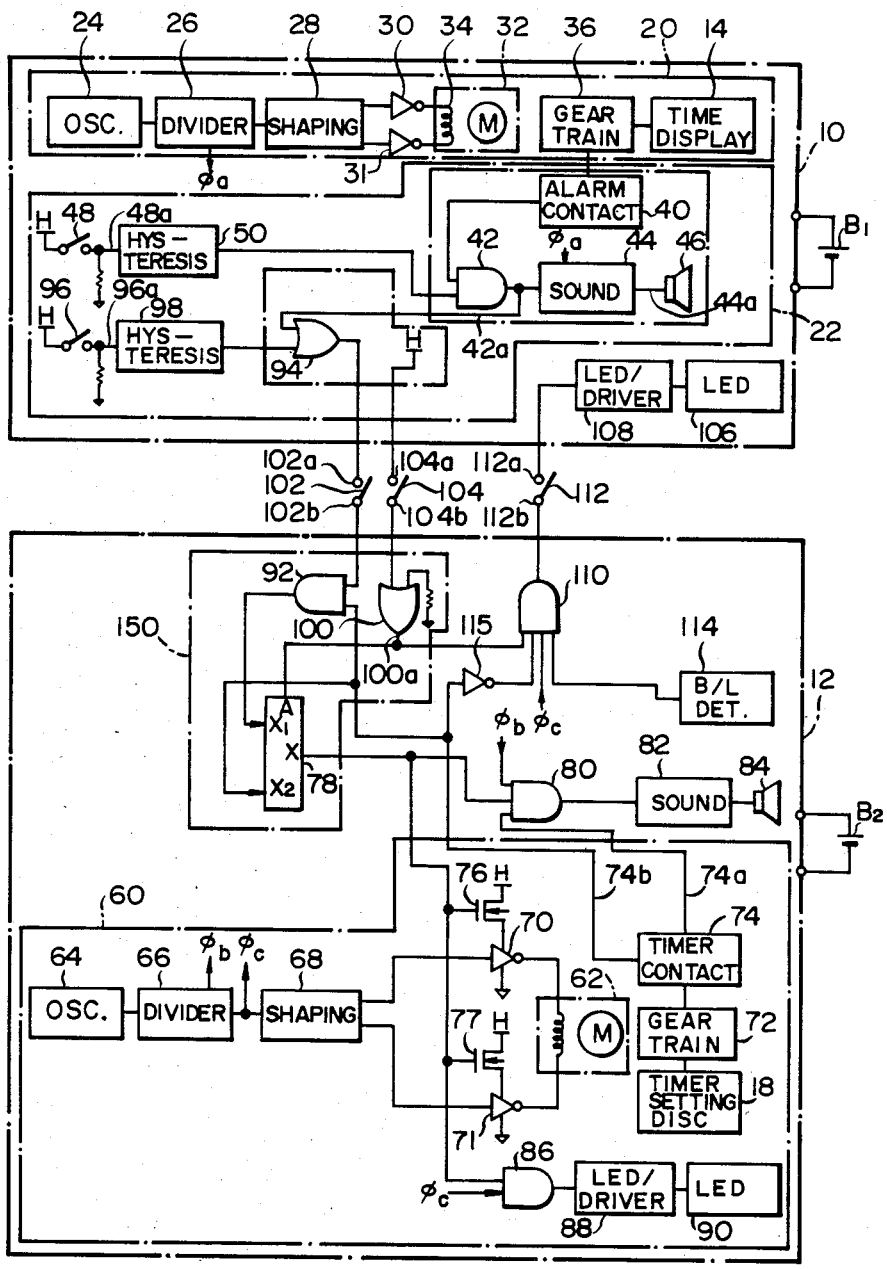
FIG. 18 is a circuit diagram of the eighth embodiment of the present invention.

FIGS. 16, 17 and 18 show the eighth embodiment of the invention which is obtained by modifying the fifth embodiment shown in FIGS. 11, 12 and 13. FIG. 16 illustrates the clock and timer sections 10 and 12 connected integrally with each other while FIG. 17 depicts these sections mechanically disconnected from each other.

The eighth embodiment is characterized by means for indicating whether or not the electrical connection between the clock and timer sections 10 and 12 is proper. For such a purpose, the clock section 10 includes an LED indicator 106 which is driven by an LED driver 108. In FIGS. 16 and 17, the LED indicator 106 is located near the bottom of the clock section 10. When the clock section 10 is connected with the timer section 12 as shown in FIG. 16, the electrical connection therebetween can be indicated with respect to whether or not it is proper.

This warning circuit includes an AND gate 110 disposed within the timer section 12. The output of the AND gate 110 is supplied to the LED drive circuit 108 of the clock section 10 through a contact unit 112 which includes a contact piece 112*a* in the clock section 10 and another contact piece 112*b* in the timer section 12.

The input of the AND gate 110 receives a changing signal in the form of the output of the OR gate 100, a signal produced by inverting the setting signal 74*b* of the timer contact unit 74 at an inverter 115 or a flashing signal $\phi c$ taken from the frequency dividing circuit 66. In the eighth embodiment, the input of the AND gate 110 further receives the output of a battery-life detecting circuit 114 which serves to detect the voltage of the power supply $B_2$ in the timer section 12. The LED indicator 106 warns any failure under all the above conditions. More particularly, the LED indicator 106 is turned on by a signal supplied from the AND gate 112 to the LED driver 108 if the clock and timer sections 10 and 12 are properly connected with each other to make the contact unit 112 conductive. If the contact unit 112 fails to be conductive, the LED indicator 106 is turned off to warn it.

If the aforementioned contact unit 104 fails to be conductive, no signal is supplied from the OR gate 100 to the AND gate 110. The LED indicator 106 is similarly turned off to indicate the failure in the contact unit 104.

This warning indication may be carried out only when the timer section 12 is not in its set position since it is meaningless when the timer section 12 is set. For this purpose, the setting signal 74*b* of the timer contact unit 74 is inverted by the inverter 115 and then supplied from the same inverter to the AND gate 110 such that the above warning indication is not effected after the timer has been set.

In the eighth embodiment, the battery voltage in the power supply $B_2$ of the timer section 12 is always detected by the battery-life detecting circuit 114. If the battery voltage is reduced below a predetermined value, the LED indicator 106 is turned off. Even if the timer section 12 is connected with the clock section 10 driven by the other power supply, therefore, the timepiece can be used without paying attention to the state of the battery in the timer section 12.

As aforementioned, the electrical connection between the clock and timer sections 10 and 12 is flashingly indicated by the LED indicator 106. If the LED indicator 106 is turned off, one can know the failure in the electrical connection therebetween.

Furthermore, it is apparent that the flashing indication also shows the expiration of the battery life in the timer section 12.

Figure 19:
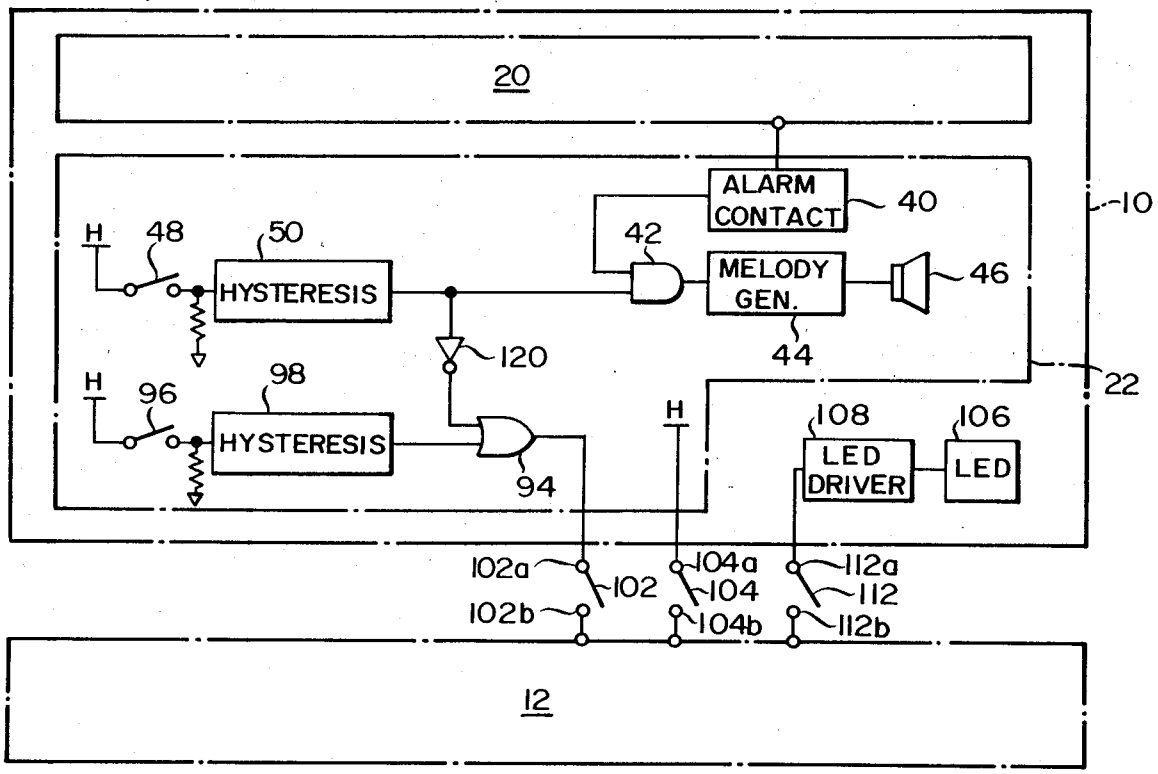
FIG. 19 is a circuit diagram of the main part of the ninth embodiment according to the present invention.

FIG. 19 shows the ninth embodiment of the present invention in which similar parts are denoted by similar reference numerals and unnecessary parts are omitted.

In the ninth embodiment, a signal from the alarm pause switch 48 is used as the secondary alarm trigger signal from the clock section 10. This alarm pause signal 48*a* is supplied from the hysteresis circuit 50 to the OR gate 94 through the inverter 120.

Figure 20:
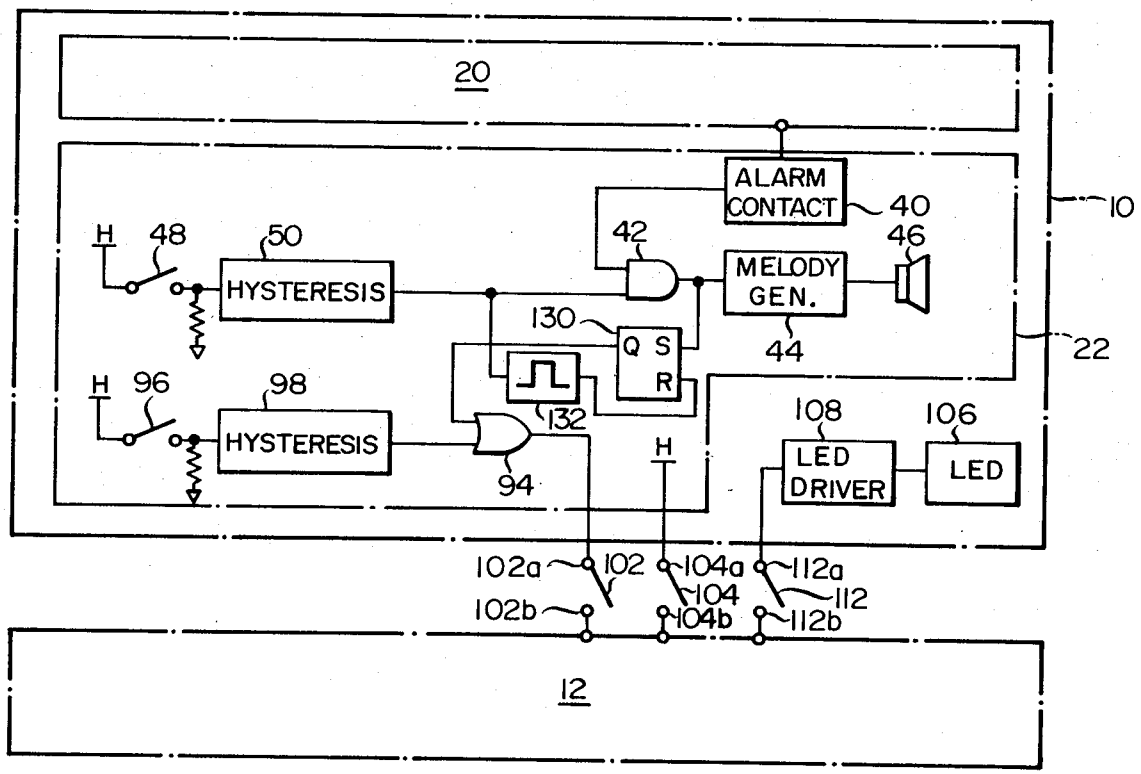
FIG. 20 is a circuit diagram of the main part of the tenth embodiment according to the present invention.

FIG. 20 shows the tenth embodiment of the invention which includes substantially the same arrangement as that of the sixth embodiment shown in FIG. 14. In the tenth embodiment, the connection between the clock and timer sections 10 and 12 is indicated by the LED indicator 106 such that the use of the timepiece can positively be prevented under any failure in the electrical connection therebetween.

In accordance with the present invention, the clock and timer sections can be used separately or in association with each other. In addition to the conventional alarm and timer functions, the secondary alarm function can be attained in the timepiece according to the present invention. Thus, the timepiece according to the present invention can be used in very broad extend. In another aspect of the present invention, the clock and timer sections 10 and 12 can mechanically be disconnected or connected into a unit. When they are mechanically connected integrally with each other, any failure in the electrical connection therebetween can be indicated such that a wrong use of the timepiece can positively be prevented in the failure of the electrical connection between the clock and timer sections.

We claim:

1. A timepiece comprising a clock section including a time indicating portion driven by a motor through a clock gear train and an alarm setting portion cooperating with said clock gear train to generate an alarm output signal at a preselected time, and a timer section driven by a motor through a timer gear train and including a timer contact unit cooperating with said timer gear train to generate timer output after passage of a preselected time period, one of said clock or timer sections including ridges and the other including dovetailed grooves for being releasably connected with each other, and sets of contacts on the connecting surface of the clock and timer section, the start of said timer section being selectively controlled by the alarm output of said alarm setting portion and by an alarm pause signal from an alarm pause switch of said alarm setting portion, and further including a secondary alarm/timer changing switch which is selectively actuated to start said timer section singly or to control said timer section by a signal from said alarm setting portion.

2. A timepiece as defined in claim 1 wherein to start said timer section, the output of the alarm setting portion is held by a latch circuit such that the timer section continues to operate after the alarm output has been generated.

3. A timepiece as defined in claim 1 or 2 further including a secondary alarm/timer changing switch which is selectively actuated to start said timer section singly or to control said timer section by a signal from said alarm setting portion.

* * * * *